US005088859A

United States Patent [19]

Devlin

[11] Patent Number: 5,088,859

[45] Date of Patent: Feb. 18, 1992

[54] RISER AND TENDON MANAGEMENT SYSTEM

[75] Inventor: Paul V. Devlin, Pearland, Tex.

[73] Assignee: Texaco Inc., White Plains, N.Y.

[21] Appl. No.: 632,674

[22] Filed: Dec. 24, 1990

[51] Int. Cl.[5] ..... B63B 35/44

[52] U.S. Cl. ..... 405/211; 405/224

[58] Field of Search ..... 405/195, 224, 211, DIG. 8, 405/DIG. 11; 114/230, 264, 265; 166/350, 367

[56] References Cited

U.S. PATENT DOCUMENTS

| | | | |
|---|---|---|---|
| 4,155,673 | 5/1979 | Yashima | 405/224 |
| 4,425,056 | 1/1984 | Hunter | 405/224 |
| 4,934,870 | 6/1990 | Petty et al. | 405/224 X |
| 4,936,710 | 6/1990 | Petty et al. | 405/224 |
| 4,938,630 | 7/1990 | Karsan et al. | 405/224 |
| 4,966,495 | 10/1990 | Goldman | 405/224 |

*Primary Examiner*—David H. Corbin

*Attorney, Agent, or Firm*—Jack H. Park; Kenneth R. Priem; Russell J. Egan

[57] ABSTRACT

A riser and tendon management system for offshore hydrocarbon production facilities has a data acquisition system with instrumentation suitable for gathering all necessary information concerning the immediate condition of the facility and a riser and tendon analysis system for comparing actual with ideal conditions for the facility. Information is generated as to what corrective action must be taken. The analysis system stores past corrective actions and results and factors this information into the current suggestion for correction thereby reducing riser and tendon stress while increasing their fatigue life.

13 Claims, 3 Drawing Sheets

RISER AND TENDON MANAGEMENT SYSTEM

BACKGROUND OF THE INVENTION

1. The Field of the Invention

The present invention relates generally to deep-sea production equipment and in particular to the operation of deep-sea offshore development platforms of the type which are used for conducting various oil field operations in deep water areas. More particularly, the present invention relates to a management system to control rigid risers and tendons in offshore floating platforms in such manner as to maximize fatigue life of risers and tendons and to maintain the spacing between the risers and tendons, thereby allowing smaller offshore vessels to be constructed and reduction in the cost of such operations. The system includes a combination of hardware and software providing data acquisition and analysis to advise the vessel crew members what adjustments are necessary and when they will be necessary.

2. Description of the Prior Art

The search for offshore deposits of crude oil and natural gas is continually being extended into deeper and deeper waters beyond the continental shelf. Where possible, one of the preferred techniques of performing the operations necessary for the production of hydrocarbons from off-shore reservoirs is to erect a structure or operating platform which is, in some fashion, secured to the sea floor. Such a technique may comprise any of a variety of structures including jackup rigs, tension-leg platforms, free-standing or guyed towers. A notable advantage of such structures is their rigid nature which significantly simplifies subsea operations during conditions which exert lateral or vertical forces on the structure. The rigid character of such structures limits their movement to less than 4° of freedom (0° for a rigid tower and up to 3° for a tension-leg platform). It has therefore been found possible to operate two or more production operations from such rigid bottom founded structures. With such rigid structures, operation of two or more conductor pipes simultaneously has not caused significant problems to arise due to the active guidance available with these systems. U.S. Pat. Nos. 2,973,046 and 4,170,266 are illustrative of platforms which are supported in a rigid or semi-rigid fashion from the sea floor. There is, however, a limit to the water depths in which rigid, bottom founded production platforms can be effectively, safely and economically operated. Where the sea depth exceeds this limit, floating platforms, such as ships or semi-submersible platforms, have found application. According to conventional procedures, a floating production vessel is dynamically moored above a well site on the ocean floor. Dynamic mooring, as opposed to rigid bottom founded support, permits the floating platform to dynamically move with up to 6° of freedom under prevailing forces, such as wave action, tidal action, sea currents and wind conditions.

As can easily be imagined, the marine risers required for production operations in very deep water become quite heavy and unwieldy. Unfortunately, the movement of a floating production vessel under the influence of weather, tide and current conditions greatly increases the difficulty of managing the riser as contrasted to the situation of rigid bottom-founded platforms since movement of the vessel excites dynamic motions in the riser systems.

Production vessels, and other apparatus employed in the production of oil offshore, are generally large and very expensive. Their operation involves rates exceeding many thousands of dollars a day, a cost which constitutes a major portion of the overall well and production costs. Thus, it is very important that the operations of each vessel be performed in such a manner as to get the maximum use out of the vessel. Ideally, the situation would be to have a plurality of wells operated from a single production platform thereby obviating the need for redundant vessels. This arrangement causes a problem of multiple risers and the need to keep them appropriately spaced so that they will not be brought into contact by the vessel movement and thereby be subject to damage and/or rupture. Clearly, if certain limits of tension or deflection angle are exceeded, a marine riser can be damaged. Damage may also occur if two risers forcibly come into uncontrolled contact with one another or if equipment being lowered by one riser were to collide with another riser. Production risers, while quite stiff over short distances, are quite flexible over the extended distances which they must traverse in deep water offshore environments. Not only are these risers subject to sea currents (often of different magnitudes and directions at different depths and times), but they are also subject to a condition in which the lower end is pinned to the ocean floor at a stationery spot while the upper end must follow the motions of the floating platforms.

Numerous attempts have been made in the past to deal with problems which arise in the design and management of marine risers for deep offshore oil well production. For example U.S. Pat. Nos. 3,983,706 and 3,817,325 disclose means for providing lateral-support and guidance to marine risers in order to limit their lateral deflection due to currents or platform movement. U.S. Pat. Nos. 3,601,187; 4,576,516 and 4,188,156 describe flexible joints and flexible riser sections for the purpose of accommodating unavoidable deflection of such risers. U.S. Pat. Nos. 3,133,345 and 4,351,261 disclose apparatus and techniques for preventing the violent collision of a riser with the floating platform if the riser were to be separated from the wellhead equipment in a planned or emergency disconnect situation. U.S. Pat. Nos. 3,434,550 and 3,999,617 are directed to methods and apparatus for lightening the riser-mud combination to reduce the compressive and tensional forces placed on the riser. U.S. Pat. Nos. 4,142,584 and 4,198,179 show the conventional approach of ganging multiple risers together as a means of avoiding riser-riser interference.

Riser and mooring management systems have been used in other capacities in the past. In offshore drilling business, mooring management systems are used to insure that the vessel remains over the well being drilled to keep the riser and drill string as vertical as possible. A riser management system has been proposed for managing side by side drilling risers in a vessel equipped with two derricks for simultaneous drilling. An example of this may be found in U.S. Pat. No. 4,819,730. The present riser and tendon management system extends the application of previous systems from the management of the offsets of two drilling risers to the management of offsets and stresses of many (typically 8 to 32) production risers and to the management of offsets and stresses of tendon mooring systems. Also, the intent of previous systems has been to improve operating efficiency. The intent of the present riser and tendon management system is to allow designers to decrease the cost of the floating production systems by decreasing riser spacing and therefore vessel size and by decreasing the amount of steel in the risers or tendons by controlling peak stresses and maximizing fatigue life.

SUMMARY OF THE INVENTION

The subject riser and tendon management system is formed by a combination of hardware and software providing data acquisition and analysis to control the movement and stresses of rigid risers and tendons in an offshore petroleum production vessel. The riser and tendon management system advises vessel crew members of required equipment adjustments to reduce peak stresses thereby improving fatigue of rigid production risers and to maintain the space between the risers or tendons while avoiding contact therebetween. The subject system allows for construction of smaller vessels while increasing the capability for each vessel to handle multiple risers and tendons. The subject system will also allow the use of tendons and risers with reduced fatigue life requirements, thereby decreasing the cost of these components.

BRIEF DESCRIPTION OF THE DRAWINGS

The present invention will now be described by way of example with reference to the accompanying drawings in which.

DETAILED DESCRIPTION OF THE PRESENT INVENTION

Figure 1:
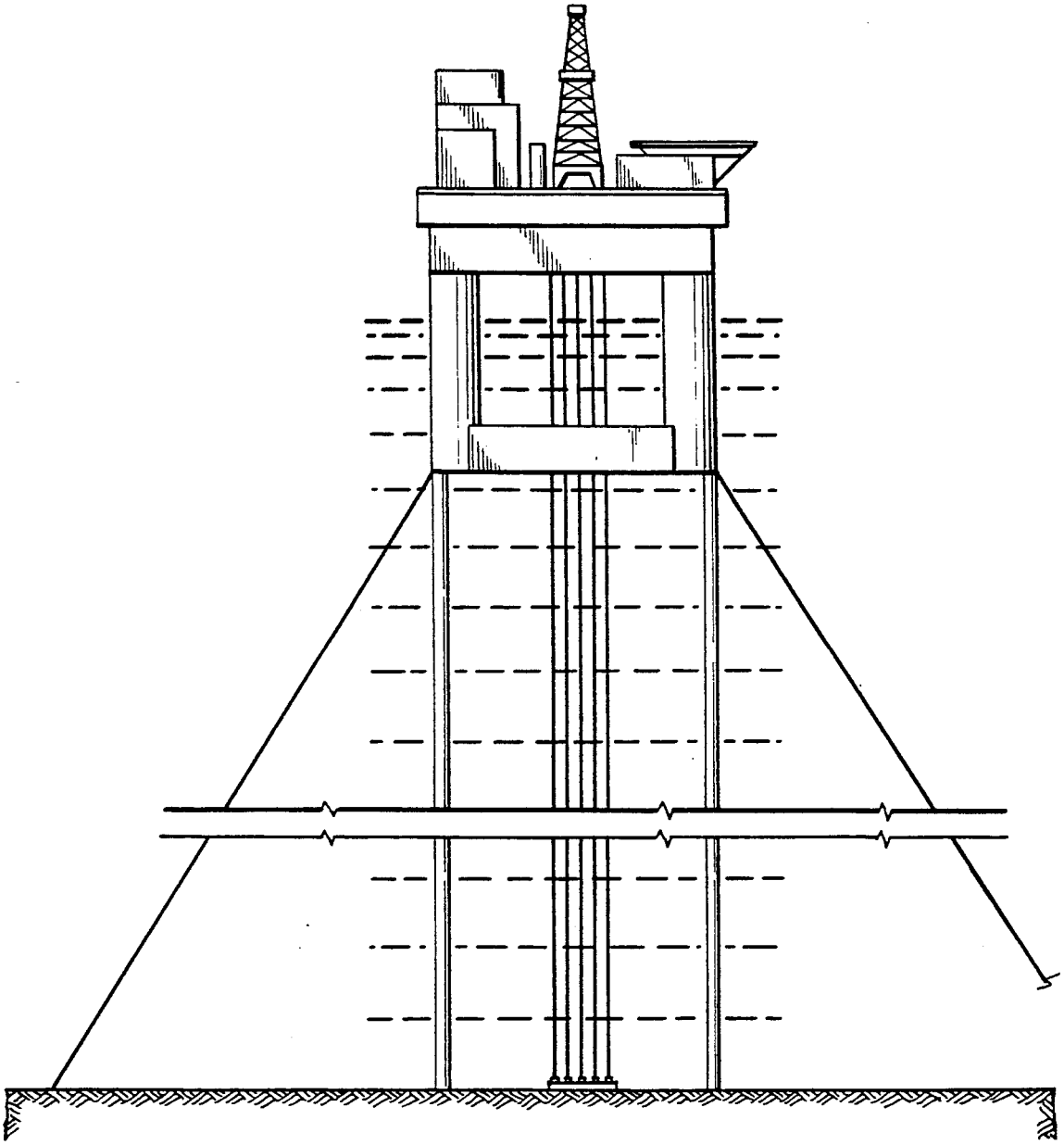
FIG. 1 is a schematic representation of a floating vessel in a typical deep water petroleum recovery operation.

Floating production systems generally consist of either a semi-submersible vessel with a catenary mooring system or a tension-leg platform with a vertical mooring system and either may use rigid production risers. In rough sea conditions, the risers are free to move with respect to each other and therefore are initially spaced far enough apart to avoid contact between adjacent risers. This is also true of the tendons used to moor a tension-leg platform. The size of the vessel, and hence the cost, is affected by the spacing required between risers and tendons.

The motion of rigid risers and tendons can be controlled by adjusting tension applied at the top of the riser or tendon, by repositioning the vessel and/or by controlling the vessel's motion. Several of these actions can be taken together to make the necessary adjustments. The subject riser and tendon management system will advise the vessel's crew of what action is required to minimize the motion of the risers and tendons. This will allow the risers and tendons to be initially spaced much closer together than has been previously possible without the use of physical restraining devices thereby allowing a reduction in the vessel's size.

The subject system can also be used to control fatigue in tendons and rigid production risers thereby extending their effective life. In this configuration, the subject system will allow tendons and rigid steel risers used with floating production systems to be designed with shorter fatigue lives which will contribute in reducing cost. In this function the software will also do a riser and tendon fatigue analysis and will advise the vessel's crew on ballast, riser, or tendon tension adjustments to increase the fatigue life.

The subject riser and tendon management system relates generally to the management of rigid production risers which connect subsea casings to production trees located above water and attached to a floating production system. This system also relates to the management of tendons used to connect vertically moored platforms to the sea floor. More specifically, the riser and tendon management system is used to control the motion of risers and tendons to insure that adjacent risers or tendons do not make incidental contact. The riser and tendon management system is also used to control riser and tendon stress to insure that design stresses are not exceeded and to minimize fatigue damage. The system is applicable to floating production systems such as semi-submersibles, tension-leg platforms and tension-leg wellhead platforms which use generally vertical rigid steel production risers as opposed to flexible riser systems. The system is also applicable to tension-leg platforms using catenary mooring or thrusters for positioning assistance.

The subject riser and tendon management system is a combination of software and hardware used to control movement, stresses, and fatigue in rigid riser and tendon systems used with offshore floating hydrocarbon production systems. The subject system consists of two major subsystems, namely the Data Acquisition System (DAS) and the Riser and Tendon Analysis System (RTAS). Both of these systems are diagrammatically shown in FIG. 2. The Data Acquisition System consists of instrumentation to monitor the mooring, thruster, riser, tendon and ballast systems. The Data Acquisition System also monitors vessel position and motion and environment. The parameters to be measured include (1) the mooring, riser, and tendon tensions; (2) vessel position; (3) vessel motions; (4) riser and tendon angles; (5) ballast quantities, and (6) thruster status. Data from the Data Acquisition System is communicated to the Riser Analysis System which includes software to analyze the riser and tendon systems and advise the operating personnel of the required action. Functions to be performed by the software include: (1) riser, tendon and mooring stress analysis; (2) vessel motion analysis; and (3) riser and tendon offset analysis. The software will issue warnings and recommend action to the vessel crew such as: (1) ballast adjustments to decrease tendon or riser peak stresses; (2) ballast, riser tension or tendon tension adjustments to increase spacing between adjacent risers; (3) mooring system or thruster adjustments to reposition the vessel and decrease the tendon and riser peak stresses.

Figure 3:
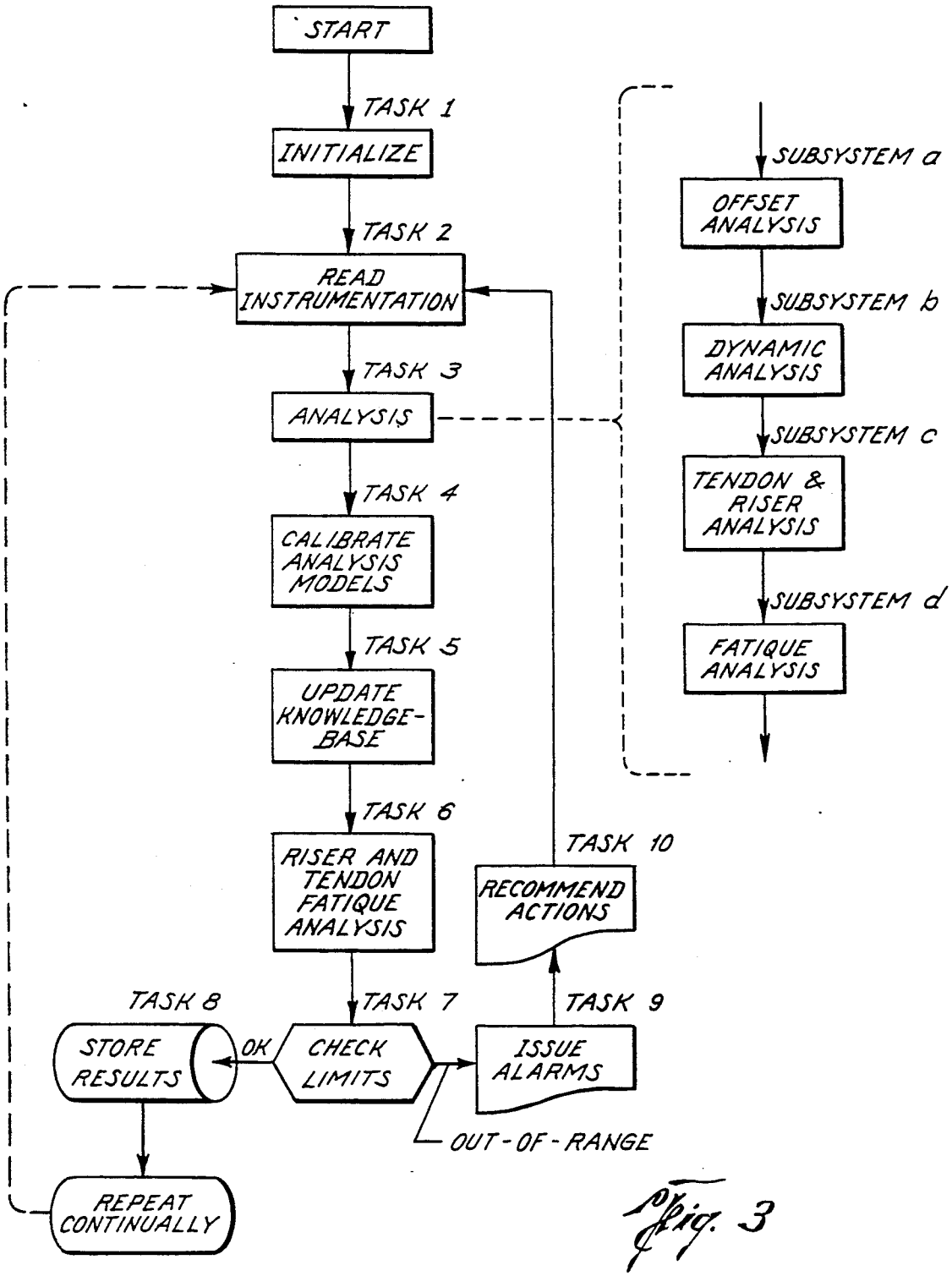
FIG. 3 is a flow chart of the operation of the present invention.

The procedures performed by the software system are shown in the flow chart of FIG. 3.

The subject riser and tendon management system uses artificial intelligence and object oriented programming techniques. The various components of the two subsystems will be defined as objects which are continually updated and communicating data between the subsystems. The data, results of the analyses, and steps taken by the operators will be stored in an artificial intelligence database called a knowledge base. This knowledge base is queried depending on input from the systems to determine future courses of action.

The riser and tendon management system is used continually during operation of the vessel, but is most critical in the event of storms when riser and tendon stresses and motions are expected to be at their maximums. The subject riser and tendon management system continually reads data from the instrumentation, performs calculations of riser and tendon stresses and offsets, and updates the knowledge base without operator intervention. However, two conditions can lead to alarms being issued by the subject riser and tendon management system that may require operator intervention. The subject riser and tendon management system knowledge base includes predefined limits for riser and tendon motions and stresses. If either of these are exceeded, a warning is issued to the operator, the knowledge base is consulted for an appropriate course of action and steps are suggested to the operator to correct the problems. After these steps are taken, the subject riser and tendon management system again reads the instrumentation to verify that the results are as expected and the knowledge base is updated with modified data that may lead to different suggestions the next time similar conditions occur. The subject riser and tendon management system also continually forecasts riser and tendon motions and stresses so that the action can be taken well in advance of problems arising. In this case an alternate set of predefined limits are used to determine when the subject riser and tendon management system should issue warnings to the operators of the vessel.

Figure 2:
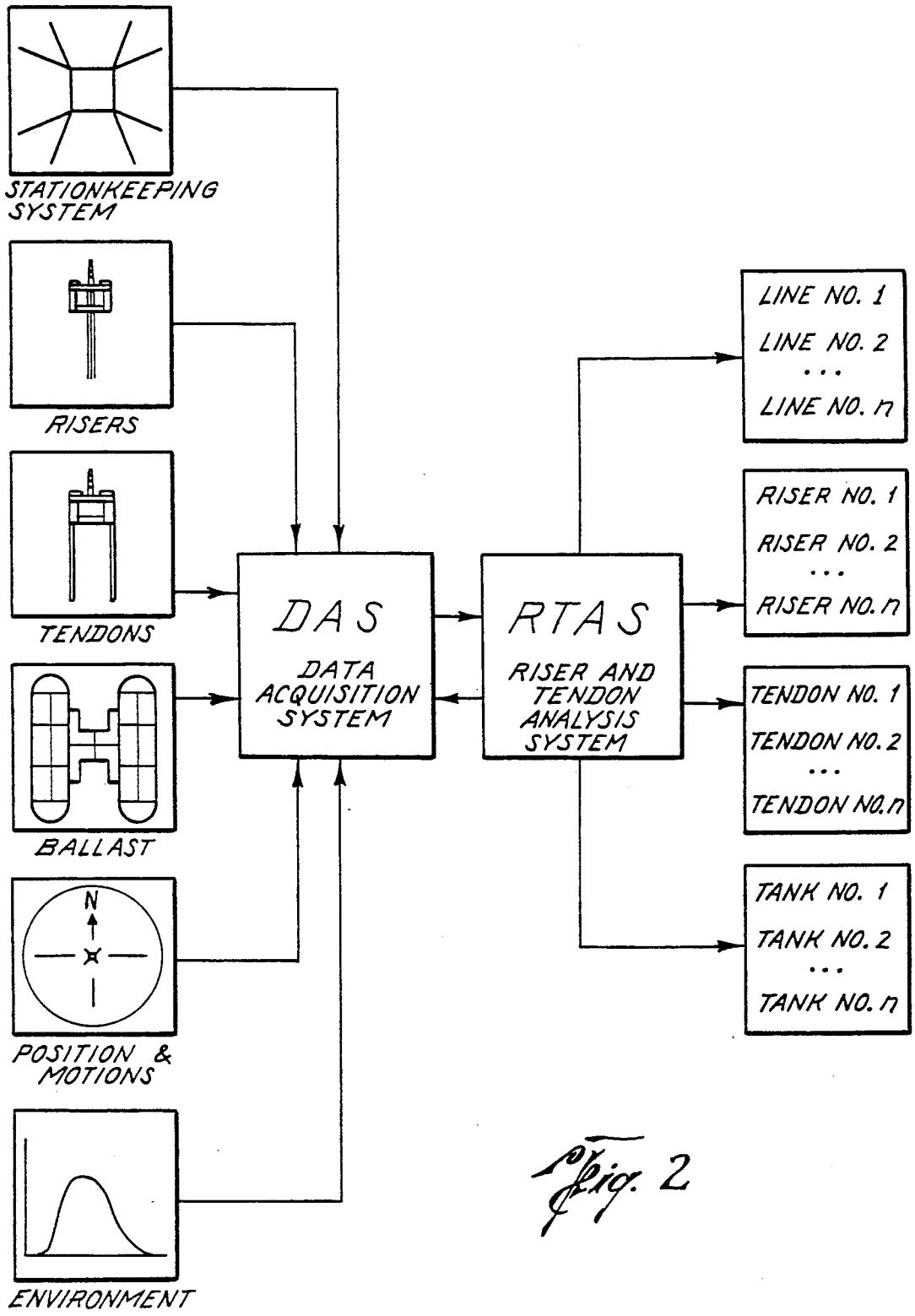
FIG. 2 is a block level schematic of the operation of the present invention.

Turning now to FIG. 2, the present invention contains two major systems, namely the Data Acquisition System and the Riser and Tendon Analysis System. The data acquisition portion is connected by known means to receive stationkeeping information, riser and tendon information, and ballast information. All of this information is gathered from the sources in known fashion. For example, measurement devices (not shown) monitor the stress placed on the riser or tendon caused by the motions of the vessel and current while other sensors monitor (also not shown) the amount of ballast controlling the level of the vessel above the ocean surface. This information is fed to the Riser and Tendon Analysis System which makes a comparison of the actual information with the desired information and sends out alarms when a situation becomes out of tolerance. When such an alarm is sounded, it will be accompanied with the correcting information. For example, say that the ocean currents and wind both come from the same direction causing additional stress to occur on one set of the stationkeeping tendons while the opposite set of tendons begins to feel slack. The warning of this condition would include instructions as to the proper course of action to correct the situation. This might include adjusting the trusters or by hauling in or by paying out cable of the stationkeeping system.

The flowchart of FIG. 3 shows how this is accomplished. The system is initialized with the desired information for proper or ideal stationkeeping of the vessel. The information coming from the sensors in the riser, ballast, and stationkeeping systems is compared to the ideal and the proper course of action determined to correct any out of tolerance situation. The system also includes comparison with similar past situations and their remedies to determine if what happened before was corrected and if there is a better correction that can be made.

As an alternative to operator intervention, the subject system can be used with an automated control system to adjust riser tensions, reposition the vessel using the mooring lines, or adjust ballast quantities to reduce riser and tendon stresses. Automated control systems would be potentially useful for vessels operating in areas subject to hurricanes. In these conditions vessels are usually abandoned by the crew if there is a significant chance that vessel will be directly in the path of a hurricane.

The subject Riser and Tendon Management System consists of two subsystems: the Data Acquisition Subsystem (DAS) and the Riser and Tendon Analysis Subsystem (RTAS) as shown diagrammatically in FIG. 2.

The Data Acquisition Subsystem portion of the present invention consists of all of the instrumentation necessary to provide the parameters required by Riser and Tendon Analysis Subsystem. The instrumentation required by the Riser and Tendon Management System is similar to instrumentation commonly used in offshore applications, such as on semisubmersible drilling vessels or on floating production systems. The hardware requires no special design and is generally described in Offshore Technology Conference Paper #4684 entitled "Instrumentation for Monitoring Behavior of Lena Guyed Tower" by W. C. Lamb Jr., H. C. Hibbard, A. L. James, W. A. Koerner and R. H. Rolthberg presented at the 1984 Offshore Technology Conference in Houston; and in the Offshore Mechanics and Arctic Engineering paper entitled "A Microcomputer System for Real Scale Monitoration of a Semisubmersible Platform" by J. A. Moreira Lima and W. Tavares, Jr. presented at the Seventh International Conference on Offshore Mechanics and Arctic Engineering Conference in Houston in 1988.

The instrumentation requirements can be divided into two categories: those required for riser and tendon analysis, consisting primarily of environmental data; and those used for comparison with the results of riser and tendon analysis, consisting of status parameters for the stationkeeping systems, riser and tendon systems, ballast systems, and vessel position and motion monitoring systems. Instrumentation of the latter type is used to calibrate certain parameters required for analysis subsystems to provide better predictions of riser and tendon offsets and stresses.

Quantities required by the Riser and Tendon Analysis Subsystem consist of: ballast quantities in tanks; riser and tendon tensions; wave height, period and direction; wind speed and direction; and current speed and direction.

Parameters which may be measured for comparison with results of the Riser and Tendon Analysis Subsystem consist of: vessel draft, trim and heel; vessel position and yaw angle; vessel six-degree-of-freedom motions; riser and tendon angles, offsets and stresses; and mooring line tensions.

Ballast quantities in tanks are typically measured with resistance or capacitance level probes or air bubble type tank level sensors. Loads due to ballast are combined with static loads on the vessel to calculate draft, trim and heel of the vessel. These quantities are then used for motion and offset analyses. Draft, trim and heel can also be measured using instrumentation and used to calibrate with the loading analysis.

Vessel draft, trim and heel can be measured using either resistance or capacitance level sensors or pressure transducers mounted on the columns of the vessel. These values are averaged over time to eliminate the effects of waves on the sensors. Draft, trim and heel can be used directly by the offset and motion analyses or can be used to calibrate the loading analysis.

Riser tensions can be measured using either strain gauges in the tensioner cables or using pressure transducers to measure pressure in the hydraulic cylinders of the tensioners. Tendon tensions can be measured using strain gauges in the tendon body or in the interface between the tendon and the platform. Riser and tendon tensions are read from instrumentation in calm conditions to obtain a static reading. This static value is used for the riser and tendon analysis. Dynamic tensions are predicted by the Riser and Tendon Analysis Subsystem and compared with the dynamic instrumentation readings for calibration of the software.

Wave data is typically measured using either resistance or capacitance wave probes or laser level sensors. The wave sensor data is processed using Fast Fourier Transform (FFT) and spectral analysis techniques to provide statistical parameters for wave height, period and direction required by the Riser and Tendon Analysis Subsystem. Wave data is used as input to all analysis subsystems. Wind data is typically measured using either a cup or propeller type anemometer. Wind data is processed by the Data Acquisition Subsystem to provide to the Riser and Tendon Analysis Subsystem average values over periods of one minute or one hour for wind speed and direction. Wind data is used to calculate vessel static offsets.

Current data can be measured using either propeller or pressure type current sensors at several depths beneath the platform. Current speed and direction as a function of depth can be measured with an acoustic doppler current profiler. Current data is used to calculate vessel offset that is required as input for the riser and tendon analysis. Current data is also used to calculate riser and tendon offsets and stresses.

Vessel position and yaw angle can be measured using acoustic beacons mounted in at least three locations on the platform with a reference transponder located on the seabed. Position can also be measured using a microwave transmission system with reference transponders on nearby facilities. Vessel position is calculated based on input from environment sensors (wind, waves and current). The calculated values are compared with the instrument values for calibration of the analyses.

Vessel motion consists of lateral translations (surge and sway), vertical translation (heave) and rotations about the longitudinal, vertical, and transverse axis of the vessel (roll, yaw and pitch). Translational motions can be measured using accelerometers that are doubly integrated to provide displacement information. Rotational motions can be measured using accelerometers in pairs. Rotational motions can also be measured using gyroscopes. Vessel motion data is processed by the Data Acquisition Subsystem using Fast Fourier Transform, spectral analyses, and statistical analysis techniques to provide statistical parameters for the vessel's six-degree-of-freedom motions to the Riser and Tendon Analysis Subsystem. Vessel motions are predicted by analyses using environment sensor input (wind, waves and current). Motions determined by the instrumentation are then compared with the calculated values for calibration of the software.

Riser and tendon angles and offsets can be measured using either accelerometers, inclinometers, or acoustic beacons mounted at several locations along the length of the riser or tendon. Riser and tendon stresses can be measured using strain gauges mounted on the body of the riser or tendon. Because the Riser and Tendon Analysis Subsystem is self-correcting, a single instrumented riser or tendon can be used to calibrate the system. It is not necessary to instrument every riser or tendon.

Riser and tendon data is processed by the Data Acquisition Subsystem using Fast Fourier Transform, spectral analyses, and statistical analysis techniques to provide statistical parameters for riser and tendon angles, offsets, and stresses to the Riser and Tendon Analysis Subsystem. Riser and tendon offsets, angles and stresses are calculated by the Riser and Tendon Analysis Subsystem. The analytic results are then compared with the instrumentation readings for calibration of the analyses. This allows for the instrumentation of only one riser and one tendon for calibration purposes. The other risers and tendons can be handled through analyses only.

Mooring line tensions can be measured using either strain gauges or hydraulic pressure transducers built into the mooring line winches or windlasses. Load measuring devices are provided with mooring winches and windlasses commonly used for mooring offshore drilling vessels and floating production vessels. Mooring line tensions can also be measured by providing strain gauged connectors in the fairleaders. Mooring line tensions are processed by the Data Acquisition Subsystem to provide average tensions to the Riser and Tendon Analysis Subsystem. Mooring line tensions are predicted by the vessel offset analysis. These quantities are then compared with the sensor readings for calibration of the analyses.

RISER AND TENDON ANALYSIS SUBSYSTEM

The functions of the Riser and Tendon Analysis Subsystem are shown in the flowchart of FIG. 3. The first task of the system is to initialize the system. In Task 1, vessel parameters are read from a static data base provided with installation of the system. These parameters define the vessel, its stationkeeping systems, and the riser and tendon systems. These parameters, which are required by the various analyses packages of the system, are never expected to change. Therefore, Task 1 is used only once and that is during system installation and startup.

During Task 2, parameters provided by the Data Acquisition Subsystem are read and saved on disk for use in Task 3 Analyses and Task 4 Calibration.

Task 3 is the primary analytic portion of the Riser and Tendon Analysis Subsystem. This Task consists of analyses to determine a) vessel position and orientation, b) vessel motion, c) riser and tendon angles, offsets, clearances, and stresses, and d) riser and tendon fatigue damage.

Subsystem (a) uses data provided by the Data Acquisition Subsystem, data stored in the initialization data base, and data provided by the knowledge base to calculate vessel offset from its primary position, angular rotation of the vessel (yaw), and orientation (i.e., draft, trim and heel). The subsystem uses data for wind speed and direction, current speed and direction, and wave height, period and direction to calculate static forces on the vessel. These static forces are used to calculate a new offset and orientation of the vessel. These values are then supplied to subsystem (b) for a dynamic analysis of the vessel. Analytic procedures required for Subsystem (a) are generally described in the API Recommended Practice 2P, "Analysis of Spread Mooring Systems for Floating Drilling Units," by American Petroleum Institute.

Subsystem (b) uses data provided by subsystem (a), data provided by the Data Acquisition Subsystem, data stored in the initialization data base, and data provided by the knowledge base to calculate dynamic response of the vessel in the six-degree-of-freedom motions surge, sway, heave, roll, yaw, and pitch. These values are then supplied back to subsystem (b) and added to the static position of the vessel to give maximum offset positions including a combination of the static and dynamic offsets. This data is then provided to subsystem (c) for dynamic analysis of risers and tendons. This subsystem uses data for wave height, period and direction. Analytic procedures required for Subsystem (b) are described by the 1953 Transactions of the Society of Naval Architects and Marine Engineers paper entitled "On the Motions of Ships in Confused Seas" by M. St. Denis and W. M. Pierson.

Subsystem (c) uses data provided by subsystems (a) and (b), data provided by the Data Acquisition Subsystem, data stored in the initialization data base, and data provided by the knowledge base. The subsystem uses data for vessel offset, motions, riser tension and current speed and direction for a dynamic analysis of riser and tendons. The dynamic analysis can use either finite-element or finite difference techniques to calculate riser and tendon angles, offsets and stresses. These values are then supplied to subsystem (d). The analytic procedures required by subsystem (c) are generally described in the API Recommended Practice 2Q "Design and Operation of Marine Drilling Riser Systems" by American Petroleum Institute.

Subsystem (d) uses data provided by subsystem (c), data stored in the initialization data base and data provided by the knowledge base to calculate fatigue damage for the risers and tendons. The analytic procedures required by subsystem (d) are generally described in API Recommended Practice 2A "Planning, Designing and Constructing Fixed Offshore Platforms" by American Petroleum Institute.

The analyses of Task 3 require certain parameters such as hull and riser/tendon added mass coefficients and riser/tendon drag coefficients that are sometimes difficult to quantify and have significant affect on results of the analyses. Task 4, Calibrate Analyses Models, is used to adjust these parameters so that the results of the analyses can better correlate with quantities provided by the Data Acquisition Subsystem. These parameters are stored in a knowledge base (KB) that is updated during Task 5 based on results of Task 4.

During Task 6, fatigue analysis is done for each of the riser and tendons.

In Task 7 the knowledge base is checked and quantities such as riser/tendon stresses, offsets and angles are compared with predefined limits. If the values are within acceptable ranges, Task 8 Store Results is executed. If the values are unacceptable, Task 9 Issue Alarms is executed.

If all checks are acceptable, results of the analyses and instrumentation quantities are archived and the knowledge base is update as required during Task 8. The Riser and Tendon Analysis Subsystem then repeats continually from Task 2.

If checks are not acceptable, alarms are issued during Task 9. Recommended actions to correct the problems are generated by Task 10 from predefined remedies in the knowledge base.

Data used by the Riser and Tendon Analysis Subsystem is provided either by the Data Acquisition Subsystem or is stored in a knowledge base. The KB consists of four data types: 1) fixed vessel and riser/tendon definition data, 2) changeable vessel and riser/tendon definition data, 3) limiting conditions, and 4) recommended remedies. The vessel, riser and tendon definition data that remains fixed consists of physical descriptions of the systems in order that the analyses packages may generate forces on the components. The vessel, riser and tendon definition data that can be changed by the analyses packages consists of hydrodynamic characteristics of the systems (i.e., added mass, damping and drag coefficients). This data is updated as required to allow the analyses results to correlate well with the data obtained from the instrumentation. Data used to define limiting conditions consists of allowable stress ranges in the risers and tendons, minimum allowable clearances between adjacent risers and tendons, maximum allowable vessel offset, etc. In cases where allowable limits are exceeded, predetermined remedies are available that are selected using expert system approaches. In other words, if limit A is exceeded but limit B is not, perhaps remedy C will be used. If limit B is exceeded while limit A is not, then remedy D may be used.

Besides the data provided by the Data Acquisition Subsystem, and the knowledge base, data may also be overridden by the computer operator. This allows the operator to input forecast wave or wind data to predict what may happen in 4 or 6 hours, for example. This also allows the operator to analyze "what-if" situations by experimenting with input parameters to determine potential problem situations.

Three conditions are important in design and operation of risers and tendons. These are: high motions of the risers and tendons that may lead to contact between adjacent risers or tendons causing damage; high stresses in the risers or tendons causing damage; and repetitive stressing of the risers and tendons causing fatigue of the metal.

These conditions do not occur simultaneously. Conditions which allow high motions of the riser or tendons do not necessarily cause high stresses nor do they necessarily cause high fatigue damage. Conversely, actions taken to decrease high stresses to acceptable values may inadvertently increase motions and lead to contact between adjacent risers. Thus, the subject Riser and Tendon Management System is used to analyze existing conditions, determine corrective actions, test these actions against analyses or against past actions, and then determine the best action to alleviate the immediate problem without causing others and without incurring undue fatigue that does not result in immediate damage but is cumulative. The parameters that are important to the dynamics of risers and tendons are motions of the vessel, tension applied at the top of the riser or tendon, and vessel offset from its mean position. Motion of the vessel can be controlled somewhat by controlling the loading on the vessel, which can be done by adding or reducing ballast in the tanks, or by using artificial damping devices. Motions of the vessel are also affected somewhat by the tension in the risers, tendons and mooring systems. Tension applied at the top of tendons and risers can be modified by either using hydraulic or mechanical tensioners or by modifying draft of the vessel (by changing ballast). Increasing tension will tend to increase axial stress in the risers and tendons but will decrease bending stress and decrease motions of the risers and tendons. Vessel position can be controlled by adjusting tensions and lengths of the mooring lines or by using thrusters. Decreasing offset will decrease both axial and bending stresses and will usually decrease motions of risers and tendons.

In day-to-day operations when sea conditions are calm, riser and tendon stresses and motions are low, it is beneficial to decrease tension applied to the riser or tendon. This may increase motions but will decrease stresses thereby decreasing fatigue. As sea conditions increase and the risers and tendons begin moving to the point of possible contact between adjacent members, it is necessary to increase tension to prevent contact between risers and tendons. By optimizing tensions in this manner, fatigue of the risers and tendons can be minimized. Also, as the sea conditions and winds increase, the vessel will offset from the calm water position. Moving the vessel back over its initial position will tend to decrease stresses thereby decreasing the potential for overstressing risers and tendons. Also, by minimizing stresses, fatigue life is increased. The vessel can be repositioned using either a catenary mooring system or thrusters.

The present invention may be subject to many modifications and changes without departing from the spirit or essential characteristics thereof. The present embodiment is therefore to be considered as illustrative and not restrictive of the scope of the invention as defined by the appended claims.

I claim:

1. A riser and tendon management system comprising:

means to set nominal conditions for said risers and tendons;

means to measure actual riser and tendon conditions;

means to compare said actual and nominal conditions of said risers and tendons; and means responsive to a differential between said actual and nominal riser and tendon conditions, which difference exceeds specified limits, and recommending corrective action to bring said risers and tendons back to within nominal conditions.

2. A riser and tendon management system used to control movement, stress and fatigue in rigid riser and tendon systems used with offshore floating hydrocarbon production facilities, said system comprising:

data acquisition means; and riser and tendon analysis means responsive to differentials between actual and nominal riser and tendon conditions as measured by said data acquisition means and adapted to recommend corrective action to return to nominal conditions.

3. A riser and tendon management system according to claim 2 wherein said data acquisition means comprises:

instrumentation suitable for monitoring riser and tendon systems, said instrumentation using as parameters riser and tendon tensions and riser and tendon angles.

4. A riser and tendon management system according to claim 2 wherein said data acquisition means comprises:

instrumentation suitable for monitoring mooring, thruster, and ballast systems, said instrumentation using as parameters mooring and ballast quantities and thruster status.

5. A riser and tendon management system according to claim 2 wherein said data acquisition means comprises:

instrumentation suitable for monitoring vessel position and environmental status, said instrumentation using as parameters vessel position and vessel motion, wind direction and strength, current direction and strength and wave height and direction.

6. A riser and tendon management system according to claim 2 wherein said data acquisition means comprises:

instrumentation suitable for monitoring riser, tendon, mooring, thruster, and ballast systems, said instrumentation using as parameters riser and tendon tension, riser and tendon angles; mooring tension, ballast quantities, and thruster status.

7. A riser and tendon management system according to claim 2 wherein said data acquisition means comprises:

instrumentation suitable for monitoring riser and tendon systems and vessel position and environmental status, said instrumentation using as parameters riser and tendon tensions; riser and tendon angles; vessel position; vessel motion; wind direction and strength; current direction and strength; and wave height and direction.

8. A riser and tendon management system according to claim 2 wherein said data acquisition means comprises instrumentation suitable for monitoring mooring, thruster and ballast systems, vessel position and environmental status, said instrumentation using as parameters mooring and ballast quantities, thruster status, vessel position, vessel motion; wind direction and strength; current direction and strength; and wave height and direction.

9. A riser and tendon management system according to claim 2 wherein said data acquisition means comprises:

instrumentation suitable for monitoring riser, tendon, mooring, thruster, ballast vessel position and vessel motion systems, said instrumentation using as parameters riser and tendon tensions, riser and tendon angles, mooring tension, ballast quantities, thruster status, vessel motion and vessel position.

10. A riser and tendon management system according to claim 2 wherein said analysis means includes:

riser, tendon and mooring stress analysis;

vessel motion analysis;

riser and tendon offset analysis; and riser and tendon fatigue analysis.

11. A riser and tendon management system according to claim 2 wherein the response from said analysis means include:

ballast adjustments to decrease tendon and/or riser peak stresses;

ballast, riser or tendon tension adjustments to increase spacing between adjacent risers;

mooring system adjustments to reposition the vessel and decrease the tendon and riser peak stresses.

12. A riser and tendon management system according to claim 2 wherein said analysis means compares proposed corrections with previous corrections.

13. A method for managing the risers and tendons of an offshore hydrocarbon production vessel, comprising the steps of:

initializing the system with static data to define the vessel, its station keeping systems, and the riser and tendon systems;

monitoring the system with respect to vessel position, orientation and motion, riser and tendon angles, offsets, clearances, and stresses and riser and tendon fatigue damage; and initiating corrective action.

* * * * *